US011476587B2

(12) United States Patent
Leung et al.

(10) Patent No.: US 11,476,587 B2
(45) Date of Patent: Oct. 18, 2022

(54) DIELECTRIC REFLECTARRAY ANTENNA AND METHOD FOR MAKING THE SAME

(71) Applicant: City University of Hong Kong, Kowloon (HK)

(72) Inventors: Kwok Wa Leung, Kowloon Tong (HK); Yuxiang Sun, Kowloon (HK)

(73) Assignee: City University of Hong Kong, Kowloon (HK)

( * ) Notice: Subject to any disclaimer, the term of this patent is extended or adjusted under 35 U.S.C. 154(b) by 593 days.

(21) Appl. No.: 16/441,323

(22) Filed: Jun. 14, 2019

(65) Prior Publication Data

US 2020/0395673 A1 Dec. 17, 2020

(51) Int. Cl.

*H01Q 19/10* (2006.01)
*H01Q 15/14* (2006.01)
*H01P 11/00* (2006.01)

(52) U.S. Cl.

CPC ..... *H01Q 19/10* (2013.01); *H01P 11/001* (2013.01); *H01Q 15/141* (2013.01)

(58) Field of Classification Search

CPC .... H01P 11/001; H01Q 15/141; H01Q 19/10; H01Q 21/0087; H01Q 3/46

See application file for complete search history.

(56) References Cited

U.S. PATENT DOCUMENTS 4,684,952 A 8/1987 Munson et al.
7,623,071 B2 11/2009 Ginn et al.
7,719,463 B2 5/2010 Migliaccio et al.
7,764,232 B2 * 7/2010 Achour ..... H01Q 15/0086 343/909
8,656,581 B2 * 2/2014 Murai ..... H01L 23/50 29/830
9,048,544 B2 6/2015 Georgiadis et al.
9,172,147 B1 * 10/2015 Manry, Jr. ..... H01Q 1/286
9,537,221 B2 1/2017 Maruyama et al.
9,537,225 B2 1/2017 Byun et al.
9,620,862 B2 4/2017 Maruyama et al.
9,620,864 B2 4/2017 Maruyama et al.
2009/0079645 A1 * 3/2009 Sotelo ..... H01Q 15/0046 343/912
2010/0085272 A1 * 4/2010 Legay ..... H01Q 19/104 343/912
2012/0105305 A1 * 5/2012 Maruyama ..... H01Q 21/0018 343/912
2020/0395673 A1 * 12/2020 Leung ..... H01Q 19/10

* cited by examiner

*Primary Examiner* — Minh N Trinh

(74) *Attorney, Agent, or Firm* — Renner Kenner Greive Bobak Taylor & Weber

(57) ABSTRACT

The invention relates to a method for making a dielectric reflectarray antenna, and a dielectric reflectarray antenna made using such method. The method includes removing, from a substrate having a dielectric layer and a first outer metallic layer arranged on one side of the dielectric layer, the first outer metallic layer to form an intermediate substrate. The method also includes cutting the intermediate substrate to integrally form a dielectric reflectarray with an array of dielectric reflector elements of the dielectric reflectarray antenna.

24 Claims, 9 Drawing Sheets

| Reflectarray | Fabrication method | Center frequency $f_0$ | Dielectric constant | No. of unit cells | Shape | Aperture area | Height | Gain enhancement at $f_0$ |
|---|---|---|---|---|---|---|---|---|
| Work A | 3D printing | 30 GHz | 4.4 | 625 | Square | $156.25\lambda_0^2$ | $0.63\lambda_0$ | 9.0 dB |
| Work B | 3D printing | 100 GHz | 2.78 | 400 | Square | $100\lambda_0^2$ | $0.77\lambda_0$ | 6.9 dB |
| Work C | Monolithic fabrication | 31 GHz | 10 | 576 | Square | $153.76\lambda_0^2$ | $0.082\lambda_0$ | 8.3 dB |
| Present Embodiment | PCB | 35 GHz | 10.2 | 446 | Circular | $153.86\lambda_0^2$ | $0.148\lambda_0$ | 9.2 dB |

*Note:* $\lambda_0$ is the wavelength in air at $f_0$.

Figure 9

DIELECTRIC REFLECTARRAY ANTENNA AND METHOD FOR MAKING THE SAME

TECHNICAL FIELD

The invention relates to a method for making a dielectric reflectarray antenna, and a dielectric reflectarray antenna made using such method.

BACKGROUND

High-gain antennas are generally used in satellite communications, radar detection, remote sensing, military and defense, etc.

Reflectarray antenna, a combination of reflectors and arrays, is one type of high-gain antenna. The basic configuration of a reflectarray antenna includes a feed source and an array of reflecting elements. Each of the reflecting elements has a respective predetermined phase to collimate or shape the incident high-gain wave-front or beam in the desired direction. The phase shifts provided by the reflecting elements in the array lattice can compensate for the differential spatial phase delays from the feed source and form a planar (or shaped) phase wave-front on the reflectarray aperture. By varying the size or configuration of the reflecting elements, different compensations can be provided. Compared with other types of high-gain antenna, reflectarray antenna has a simpler structure (when compared with parabolic reflector antenna which requires bulky reflectors) and is more cost-effective (when compared with phase array antenna which requires expensive phase shifters).

Early reflectarray antennas were realized using microstrip antennas. However, microstrip antennas suffered from surface-wave, ohmic-loss, and narrow bandwidths especially at millimeter wave frequencies. To ameliorate some of the problems associated with microstrip antennas, the more recent reflectarray antennas are dielectric reflectarray antenna, which is compact size, provides low loss and ease of integration with circuits.

Dielectric reflectarray antenna arranged for operation at micro-wave frequencies can be fabricated relatively easily because the misalignments of the dielectric reflector elements, if any, are generally small compared with the wavelength and the size of the elements.

Dielectric reflectarray antenna arranged for operation at the millimeter-wave band, however, is small and difficult to make. Specifically, the dielectric reflector elements of the array are small and hence difficult to be fixed or mounted accurately (misalignment affects performance).

One existing solution to address this problem is to use three-dimensional (3D) printing technology to fabricate the array of dielectric reflector elements in the dielectric reflectarray antenna. Problematically, however, the dielectric constants (or relative permittivities) of materials suitable for use in 3D printing are usually low, and the use of material with low dielectric constants would undesirably lead to large antenna size and low antenna gain.

SUMMARY OF THE INVENTION

It is an object of the invention to address the above needs, to overcome or substantially ameliorate the above disadvantages or, more generally, to provide an improved dielectric reflectarray antenna. It is another object of the invention to provide a dielectric reflectarray antenna (for transmission and/or receiving) that can be made simply and cost-effectively. Preferably, the dielectric reflectarray antenna is adapted for millimeter-wave operations. It is another object of the invention to provide a high gain dielectric reflectarray antenna suitable for use, e.g., in satellite communications, radar detection, remote sensing, military and defense applications.

In accordance with a first aspect of the invention, there is provided a method for making a dielectric reflectarray antenna. The method includes removing, from a substrate having a dielectric layer and a first outer metallic layer arranged on one side of the dielectric layer, the first outer metallic layer to form an intermediate substrate. The method also includes cutting the intermediate substrate to integrally form an array of dielectric reflector elements of the dielectric reflectarray antenna. Integrally forming the array of dielectric reflector elements eliminates the need to align and assemble or otherwise attach separate pieces of dielectric reflector elements.

In one embodiment of the first aspect, the substrate further includes a second outer metallic layer arranged on the other side of the dielectric layer. The intermediate substrate includes the dielectric layer and the second outer metallic layer. The array of dielectric reflector elements includes the dielectric layer and the second outer metallic layer that have not been cut.

In one embodiment of the first aspect, the substrate consists only of: the dielectric layer, the first outer metallic layer, and the second outer metallic layer. In other words, in such embodiment, the substrate only has 3-layers.

In one embodiment of the first aspect, the substrate is a single PCB substrate (base material that can be used for producing a PCB).

In one embodiment of the first aspect, the first outer metallic layer is a copper cladding layer. In one embodiment of the first aspect, the second outer metallic layer is a copper cladding layer. In the embodiments with the second outer metallic layer, the thickness of the first and second outer metallic layers can be the same or different.

In one embodiment of the first aspect, the dielectric layer has a dielectric constant of at least 5, preferably at least 6, preferably at least 7, and more preferably at least 10.

In one embodiment of the first aspect, the removing step includes laser-etching the first outer metallic layer.

In one embodiment of the first aspect, the removing step includes chemically-etching the first outer metallic layer.

In one embodiment of the first aspect, the cutting step includes cutting the intermediate substrate using a milling cutter.

In one embodiment of the first aspect, the cutting step includes cutting the intermediate substrate using a computer-numerical-controlled milling cutter. The computer-numerical-controlled milling cutter may include or be operably connected with a processor that controls the cutter to perform cutting based on a predetermined pattern.

In one embodiment of the first aspect, each of the dielectric reflector elements includes a reflector portion for controlling a reflection phase response and a connection portion for directly connecting with at least one other adjacent dielectric reflector element. The reflector portion and the connection portion may be of different form and shape. Each of the dielectric reflector elements may have the same or similar form and shape (size may be different). Each dielectric reflector element can be considered to be in a "unit cell". The size of a footprint of a "unit cell", in plan view, may be smaller than 50 mm×50 mm, more preferably smaller than 10 mm×10 mm, yet more preferably below 5.95 mm×5.95 mm.

In one embodiment of the first aspect, the connection portion includes one or more arms extending from the reflector portion.

In one embodiment of the first aspect, the connection portion of at least some of the dielectric reflector elements includes a plurality of arms extending from the reflector portion, the plurality of arms are spaced apart evenly.

In one embodiment of the first aspect, the reflector portion is generally cylindrical. Alternatively, the reflector portion may be shaped as any polygonal-prism such as a cuboid.

In one embodiment of the first aspect, the connection portion includes one or more arms extending radially from the generally-cylindrical reflector portion. The arm(s) may be shaped as any polygonal-prism such as a cuboid.

In one embodiment of the first aspect, the method also includes attaching a conductive layer to the array of dielectric reflector elements. The conductive layer may include a conductive bonding film.

In one embodiment of the first aspect, the method also includes attaching a conductive layer to the second outer metallic layer of the array of dielectric reflector elements.

In accordance with a second aspect of the invention, there is provided a dielectric reflectarray antenna formed using the method of the first aspect. Preferably, the dielectric reflectarray antenna is made from the substrate that further includes the second outer metallic layer in the first aspect.

In one embodiment of the second aspect, the dielectric layer has a dielectric constant of at least 5, preferably at least 6, preferably at least 7, and more preferably at least 10.

In one embodiment of the second aspect, each of the dielectric reflector elements includes a reflector portion for controlling a reflection phase response and a connection portion for directly connecting with at least one other adjacent dielectric reflector element. The reflector portion and the connection portion may be of different form and shape. Each of the dielectric reflector elements may have the same or similar form and shape (size may be different). The dielectric reflector element can be considered to be in a "unit cell". The size of a footprint of a "unit cell", in plan view, may be smaller than 50 mm×50 mm, more preferably smaller than 10 mm×10 mm, yet more preferably below 5.95 mm×5.95 mm.

In one embodiment of the second aspect, the connection portion includes one or more arms extending from the reflector portion.

In one embodiment of the second aspect, the connection portion of at least some of the dielectric reflector elements includes a plurality of arms extending from the reflector portion, the plurality of arms are spaced apart evenly.

In one embodiment of the second aspect, the reflector portion is generally cylindrical. Alternatively, the reflector portion may be shaped as any polygonal-prism such as a cuboid.

In one embodiment of the second aspect, the connection portion includes one or more arms extending radially from the generally-cylindrical reflector portion. The arm(s) may be shaped as any polygonal-prism such as a cuboid.

In one embodiment of the second aspect, the dielectric reflectarray antenna further includes a conductive layer attached to the second outer metallic layer of the array of dielectric reflector elements. The conductive layer may include a conductive bonding film.

In one embodiment of the second aspect, the dielectric reflectarray antenna further includes a feed source for transmitting a polarized signal to the array of dielectric reflector elements. The feed source may be arranged at a focal point of the array of dielectric reflector elements. The feed source may include a feed horn.

In one embodiment of the second aspect, the dielectric reflectarray antenna is a millimeter-wave dielectric reflectarray antenna.

In accordance with a third aspect of the invention, there is provided a communication apparatus having the dielectric reflectarray antenna of the second aspect. The communication apparatus may be a satellite communication apparatus. The communication apparatus may be a transmitting apparatus (which makes use of the dielectric reflectarray antenna for transmission), a receiving apparatus (which makes use of the dielectric reflectarray antenna for receiving), or a transceiver apparatus (which makes use of the dielectric reflectarray antenna for transmission and receiving).

BRIEF DESCRIPTION OF THE DRAWINGS

Embodiments of the invention will now be described, by way of example, with reference to the accompanying drawings in which:

FIG. 9 is a table showing a comparison of performance of the dielectric reflectarray antenna in one embodiment of the invention against 3 different existing dielectric reflectarray antennas.

DETAILED DESCRIPTION OF THE PREFERRED EMBODIMENT

Figure 1B:
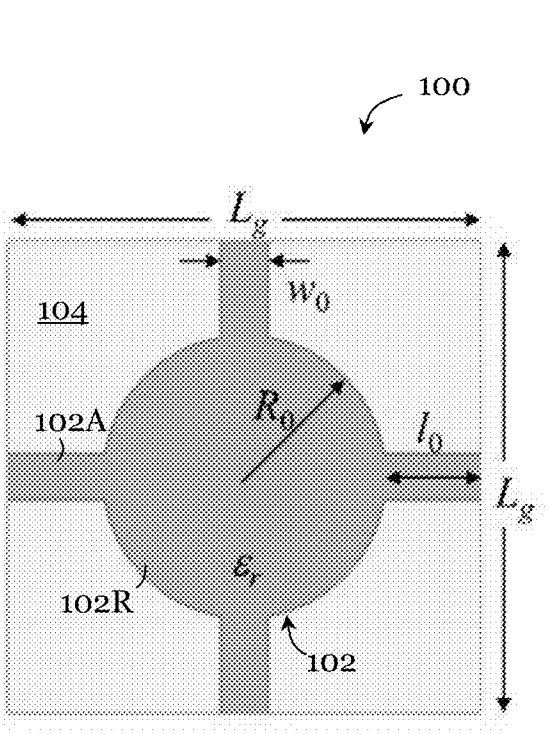
FIG. 1B is a plan view of the unit cell (with a dielectric reflector element) of FIG. 1A.
Figure 1A:
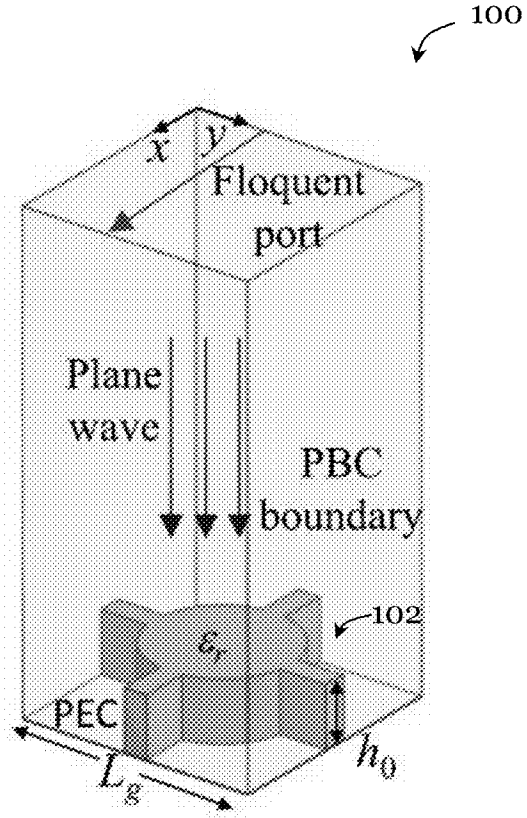
FIG. 1A is a perspective view of a unit cell (with a dielectric reflector element) of a dielectric reflectarray antenna in one embodiment of the invention.

Referring to FIGS. 1A and 1B, there is shown an illustration of a unit cell 100 of an array in a dielectric reflectarray antenna in one embodiment of the invention. In this embodiment, the unit cell 100 was designed with ANSYS HFSS (a 3D electromagnetic simulation software for designing and simulating high-frequency electronic products) to obtain the required reflection phase response. A Floquet model was used with the periodic boundary condition provided by HFSS. In this example, the size and reflection amplitude of the unit cell 100 are assumed to be the same as or similar to those of the adjacent unit cells in the array. In the example, the size variations of the adjacent elements are assumed to be small.

As shown in FIGS. 1A and 1B, the unit cell 100 is a "square unit cell" (in plan view, squared contour) that includes a dielectric reflector 102 (also a resonator) element arranged on a conductor ground plane 104. In this example, the dielectric reflector element 102 has a dielectric constant of $\varepsilon_r$=10.2, a thickness of $h_0$=1.27 mm, a loss tangent of tan $\delta$=0.0023 (at 10 GHz), and a periodicity (also the repeating 1D dimension of each unit cell) of $L_g$=5 mm, which gives an electrical length of 0.583$\lambda_0$ at 35 GHz. For a frequency of 40 GHz and an incident angle of 15° (provided by the feed source), the maximum allowable periodicity was calculated to be 5.95 mm. It was found by simulation that the grating lobes can be avoided from 30 GHz to 40 GHz by using $L_g$=5 mm. In this example, in HFSS, the unit cell 100 was excited by the Floquet port to have a plane-wave illumination.

Referring to FIGS. 1A and 1B, the dielectric reflector element 102 of the unit cell 100 has a cylindrical dielectric reflector portion 102R for controlling a reflection phase response and four evenly spaced radially extending dielectric arms 102A (collectively, a connection portion) for directly connecting with respective adjacent dielectric reflector element. The cylindrical reflector portion 102R has a radius $R_0$, which can be varied to obtain the required reflection phase response. Each arm 102A has a width $w_0$ and length (radially extending) $l_0$ which equals to $L_g/2-R_0$. As $R_0$ can be varied to meet the predetermined phase requirement, $l_0$ can also be varied across the reflectarray. In this embodiment, the direct connection of adjacent dielectric reflector elements 102 avoids the need to attach and align separately formed elements, thus eliminates alignment effort and misalignment issues. The entire dielectric reflector element 102 and hence the entire array of dielectric reflector elements are attached, at the bottom side, to the conductor ground plane 104.

Figure 2:
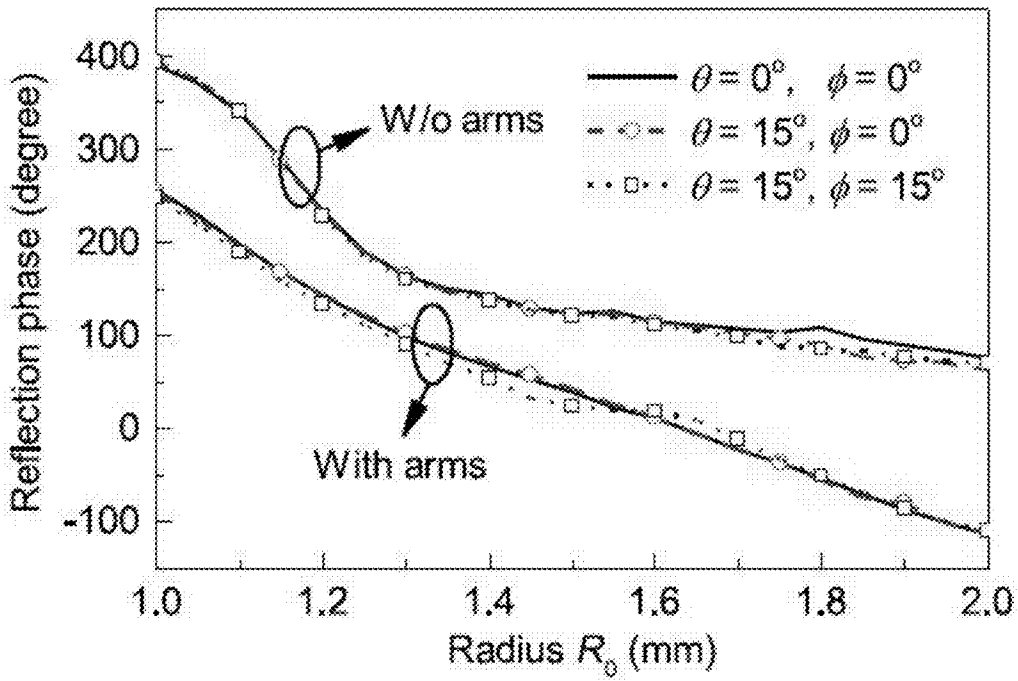
FIG. 2 is a graph showing simulated reflection phase of the unit cell as a function of radius $R_0$ of the cylindrical reflector portion of the dielectric reflector element for normal incidence ($\theta=0°$, $\phi=0°$) and oblique incidences ($\theta=15°$, $\phi=0°$; $\theta=15°$, $\phi=15°$) at 35 GHz.

FIG. 2 shows the simulated reflection phase of the unit cell of FIGS. 1A and 1B as a function of $R_0$ for normal ($\theta$=0°, $\phi$=0°) and oblique incidences ($\theta$=15°, $\phi$=0°; $\theta$=15°, $\phi$=15°) (by the feed source) at 35 GHz. It can be seen that for each incident angle, the reflection phase has a good linearity with full coverage of 360° when $R_0$ increases from 1 to 2 mm. This result is satisfactory as it implies that no sharp changes of $R_0$ are needed for the adjacent unit cells. For the same unit cell, only relatively small differences in reflection phases (with a maximum of 25°) are found for different incident angles. Thus, in this example, the normal incidence can be used to approximate the oblique cases in the reflectarray design. The loss of the reflection amplitude was also studied. It was found that the loss is lower than 0.4 dB from 30 GHz to 40 GHz. The loss is attributed to the dielectric material loss and metallic loss. With a reflection loss of about 0.3 dB, the reflection coefficient is about 0.964 and most of the energy is reflected. In this example, the reflection amplitudes of all the unit cells were found to be nearly the same.

FIG. 2 also shows the simulated reflection phase of the unit cell of FIGS. 1A and 1B without the arms as a function of $R_0$ for normal ($\theta$=0°, $\phi$=0°) and oblique incidences ($\theta$=15°, $\phi$=0°; $\theta$=15°, $\phi$=15°) (by the feed source) at 35 GHz. It can be seen that for the unit cell with arms, compared with the unit cell without arms, a larger reflection phase range and a better linearity can be obtained.

Figure 3:
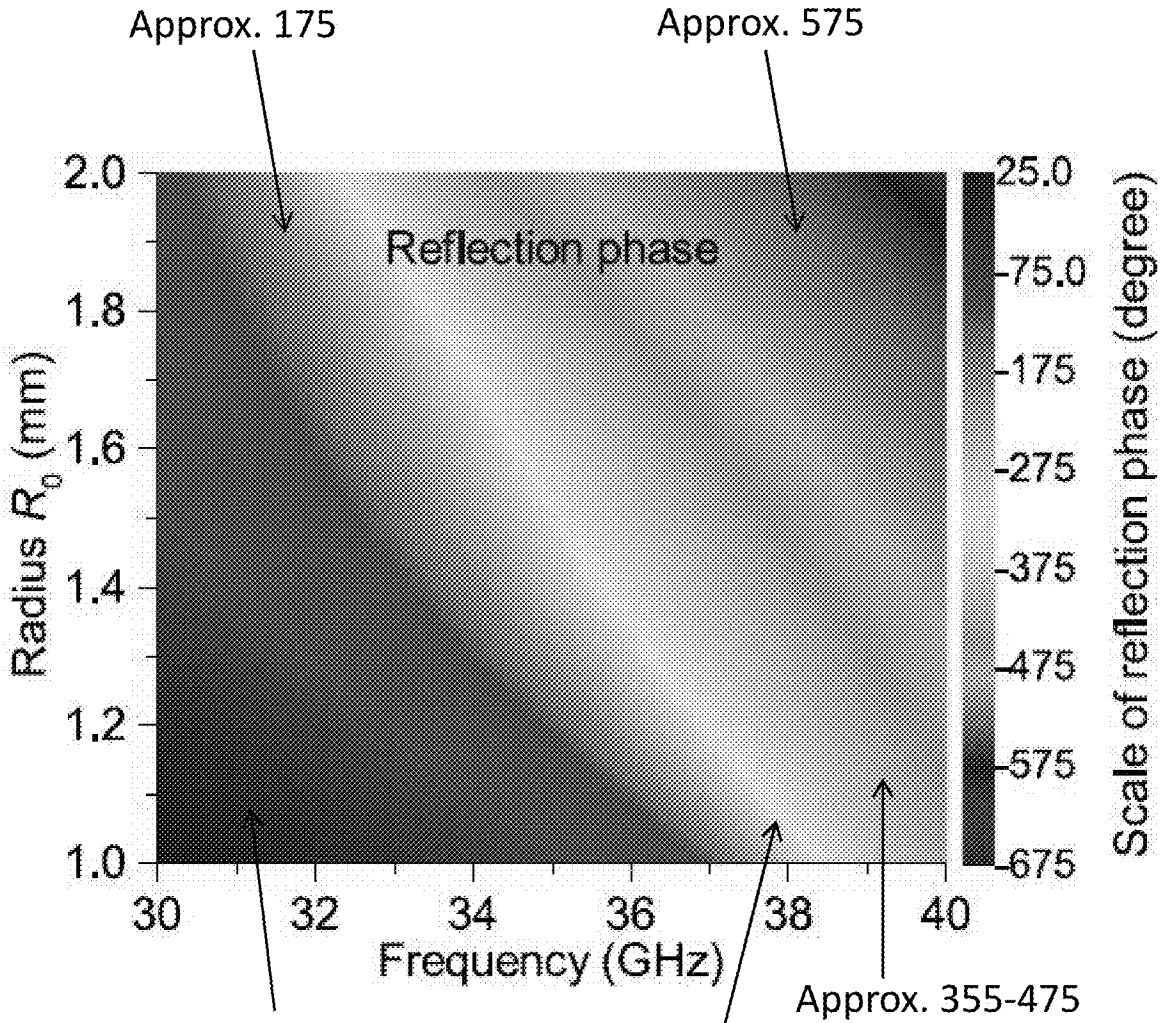
FIG. 3 is a plot showing the relationship between the radius $R_0$ of the cylindrical reflector portion of the dielectric reflector element and the scale of the reflection phase from 30 GHz to 40 GHz.

FIG. 3 shows reflection phase contour from 30 GHz to 40 GHz for different radius $R_0$ of the cylindrical reflector portion of the dielectric reflector element and scale of the reflection phase. As shown in FIG. 3, linear reflection phase responses are obtained across the entire 30 GHz to 40 GHz frequency range. The phase response can fully cover 360° around the center frequency of 35 GHz. However, the phase coverage gradually decreases as the frequency increases. The phase coverages are 220° at 30 GHz and 190° at 40 GHz, respectively.

The design and fabrication processes of the dielectric reflectarray antenna are now described. To build the dielectric reflectarray antenna, firstly, a phase compensation over the circular array aperture of the antenna is calculated. For each dielectric reflector element in the array, the required phase compensation can be calculated by using the formulas disclosed in J. Huang and J. A. Encinar, *Reflectarray Antennas*, Hoboken, N.J., USA: Wiley, 2008 and D. M. Pozar, S. D. Targonski, and H. D. Syrigos, "*Design of millimeter wave microstrip reflectarrays," IEEE Trans. Antennas Propag.*, vol. 45, no. 2, pp. 287-296, February 1997.

In this example, 24 unit cells are arranged along the x- (or y-) axis of the circular (plan view) reflectarray antenna, giving an antenna diameter of D=120 mm and an array with a total of 446 unit cells. The ratio between the focal length ($L_f$) (relative to the feed source) and diameter is given by $L_f$/D=0.857. The design formulas allow arbitrary incident angles and mainbeam directions. In this example, an oblique incidence (i.e., 15°) is considered because it avoids a potential blocking problem associated with the feed source (e.g., feed horn). in this case, the specular reflection direction is chosen as the main-beam direction to fully utilize any reflected power (a common practice for reflectarray design; as there is always specular reflection regardless of the choice of the main-beam direction, and the specular reflection will become a power loss if it is not the main-beam direction).

Figure 4:
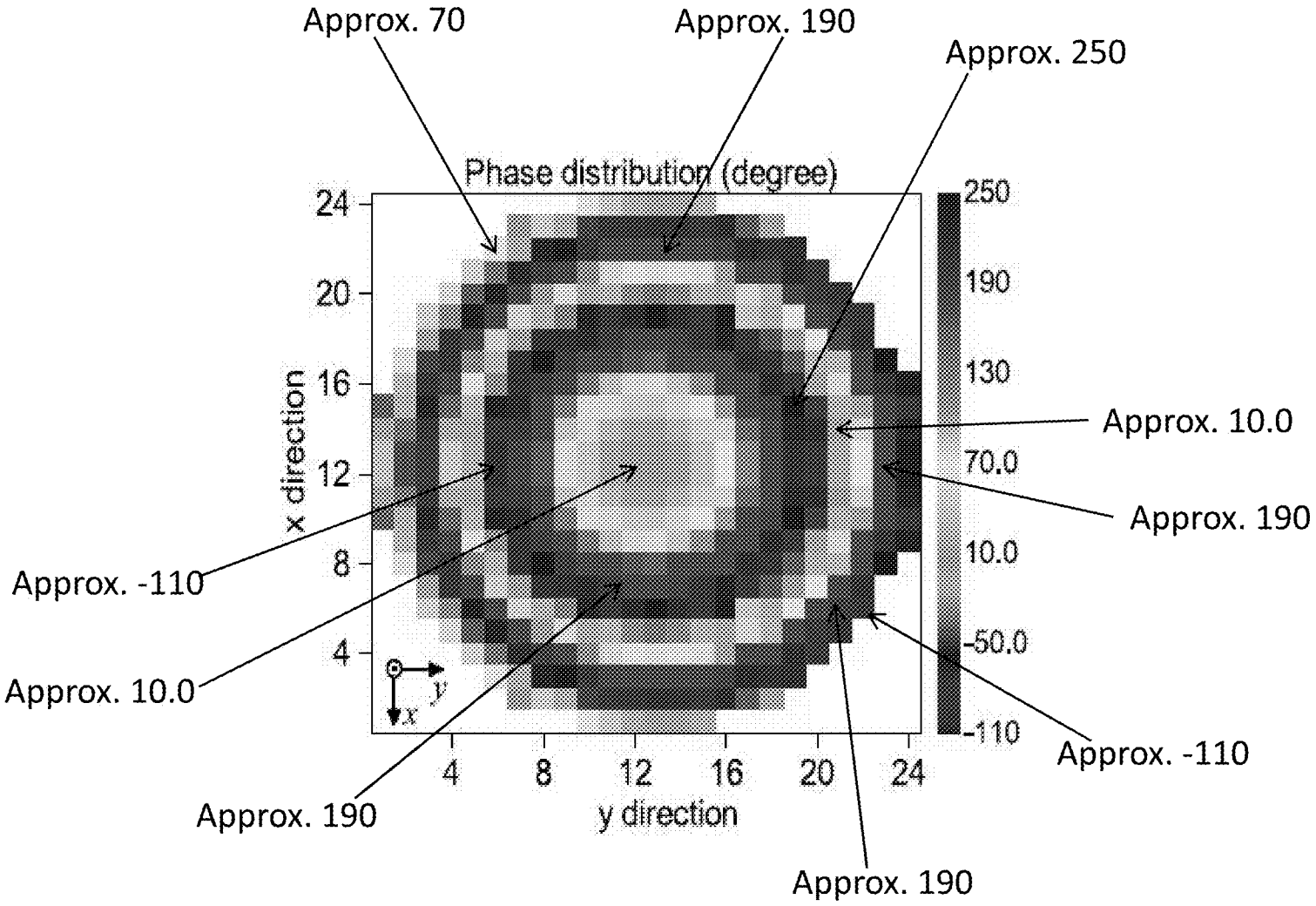
FIG. 4 is a plot showing the determined phase distribution over the dielectric reflectarray (with circular cross section) at 35 GHz.

FIG. 4 shows the calculated required phase distribution over the circular array (or aperture) of the entire dielectric reflectarray at 35 GHz. The calculation was performed by a MATLAB script. The MATLAB script was used to determine the radius $R_0$ of the cylindrical dielectric reflector in each unit cell of the dielectric reflectarray based on the phase curve of the unit cell in FIG. 2 and the phase distribution of the reflectarray aperture in FIG. 4. With the radius information, the reflectarray model can be automatically built in HFSS by using the script. The model was simulated together with the feed source (e.g., feed horn).

To verify the HFSS simulation illustrated above, a prototype was fabricated using a single dielectric substrate. The prototype has a dielectric constant of $\varepsilon_r$=10.2, a thickness of $h_0$=1.27 mm, and loss tangent of 0.0023 (at 10 GHz).

Figure 5B:
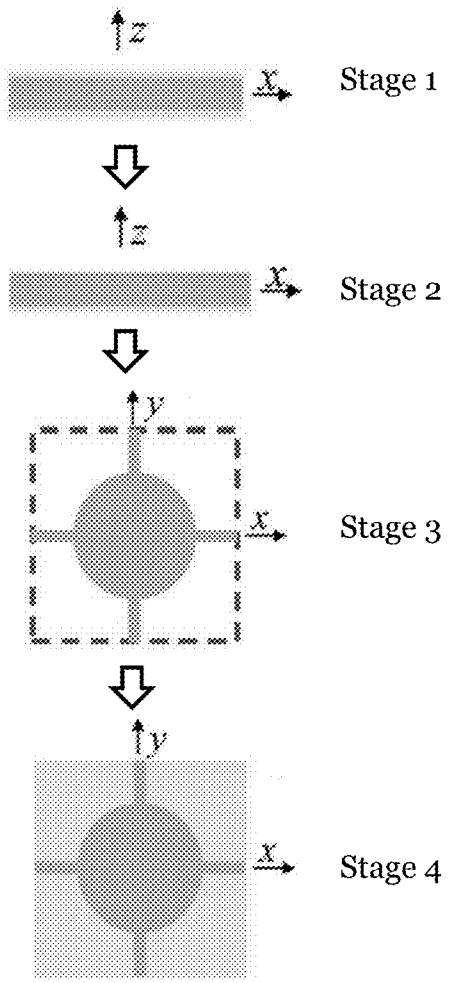
FIG. 5B is a flow diagram illustrating the change for a unit cell of the dielectric reflectarray antenna when the method of 5A is performed.
Figure 5A:
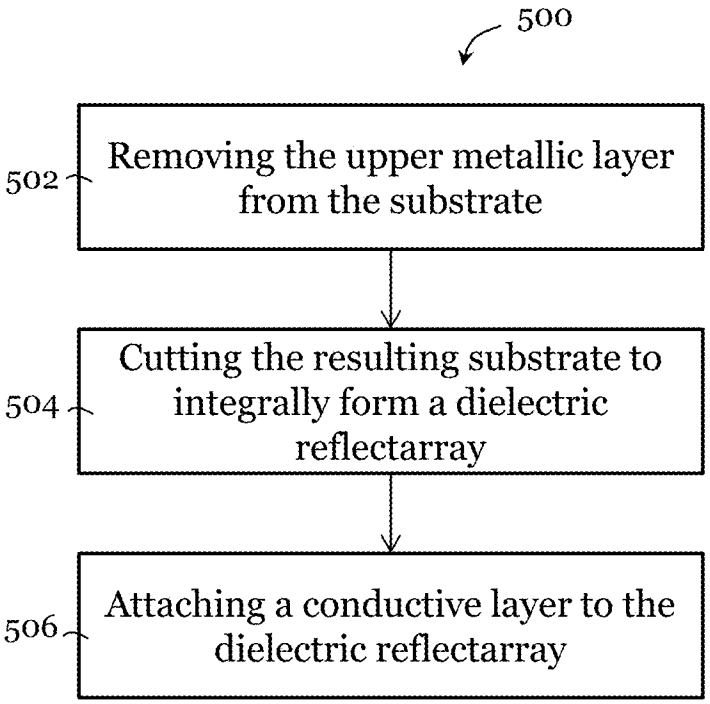
FIG. 5A is a flow chart showing a method for making a dielectric reflectarray antenna in one embodiment of the invention.

FIG. 5A shows a method 500 for making a dielectric reflectarray antenna in one embodiment of the invention. The method begins in step 502, in which a substrate having a dielectric layer and a first outer metallic layer arranged on one side of the dielectric layer is processed to remove the first outer metallic layer. The substrate may be a PCB substrate and the first outer metallic layer may be a copper cladding layer. The dielectric layer may have a dielectric constant of at least 5. The substrate optionally includes a second outer metallic layer (e.g., copper cladding layer) arranged on the other side of the dielectric layer (which, if present, is not removed in step 502). The removal of the first outer metallic layer can be performed using laser or chemical etching. After step 502, the method 500 proceeds to step 504, in which the resulting processed substrate to cut to integrally form an array of dielectric reflector elements of the dielectric reflectarray antenna. The cutting may be performed using a milling cutter, or a computer-numerical-controlled milling cutter that includes or is operably connected with a processor that controls the cutter to perform cutting based on a predetermined pattern. The cutting may be performed such that unit cells of any shape and form, such as those illustrated in FIGS. 1A and 1B, are produced. In this cutting process, the dielectric layer and the second outer metallic layer are both cut such that the un-cut parts of the dielectric layer and the second outer metallic layer preferably attach to each other and have the same shape. Finally, in step 506, a conductive layer (e.g., conductive bonding film) is attached to the uncut second outer metallic layer of the array of dielectric reflector elements, to provide a conducting ground plane.

FIG. 5B shows, in one example, the change of a unit cell of the dielectric reflectarray antenna when the method of 5A is performed. In stage 1 before the method 500 is performed, the substrate is provided. The substrate a 3-layer PCB substrate with a dielectric layer sandwiched by opposite outer copper cladding layers. When step 502 is performed, the upper copper cladding layer is removed. The lower copper cladding layer and the dielectric layer remain. Then, when step 504 is performed, the dielectric reflector element with a cylindrical dielectric reflector portion and four evenly-spaced radially extending arms is formed (by removing the other parts of the dielectric layer and lower cladding layer). In Stage 3, the construct includes the lower copper cladding, which is not clearly illustrated as it is arranged just under the reflector portion and arms. The lower copper cladding layer facilitates the bonding process of a thin conductive bonding film to the dielectric. The thin conductive bonding film, shaped as the unit cell (not the dielectric reflector element), provides a thin ground plane stuck to the bottom of the substrate (attach directly to the lower copper cladding layer). Stage 4 shows the final construction of the unit cell. By making the reflector elements with connecting arms, adjacent elements can be directly connected and all the reflector elements can be fabricated and fixed in one go. As a result, no further alignments of element positions are needed and the misalignment problem of the elements can be avoided.

It can be roughly estimated that the operating frequency of this embodiment of the method can be up to ~100 GHz as the fabrication precision of this method is about 0.05 mm (based on the understanding that the operating frequency of a microstrip structure fabricated on a PCB can be up to 250 GHz, and the general fabrication precision of a printed antenna is about 0.02 mm)

Figure 6B:
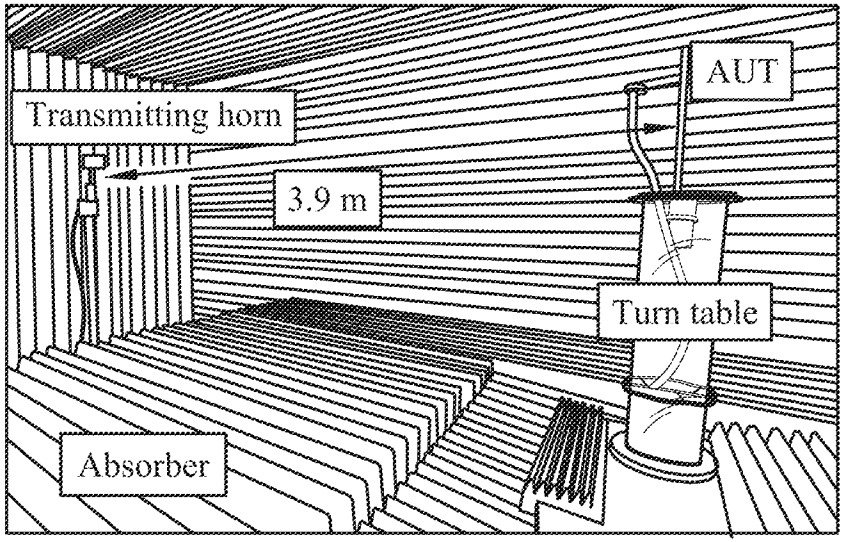
FIG. 6B is a photo showing a measurement setup in an anechoic chamber for testing the prototype of FIG. 6A.
Figure 6A:
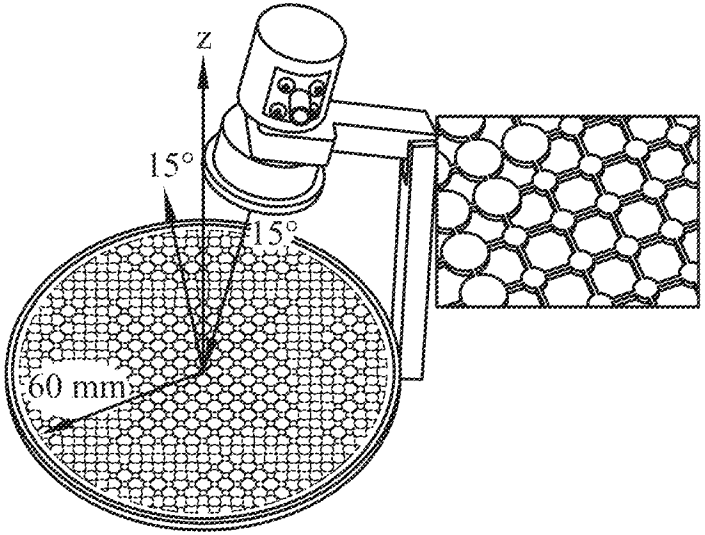
FIG. 6A is a photo showing a prototype of a dielectric reflectarray antenna (with zoom-in view of some connected dielectric reflector elements of the dielectric reflectarray antenna) in one embodiment of the invention.

FIG. 6A shows the fabricated prototype of the dielectric reflectarray antenna and the enlarged view of some unit cells. As shown in FIG. 6A, a custom-made plastic supporter was deployed to accommodate the reflectarray and to hold the feed horn at the focal point of the reflectarray (in this example, 15° from the z-axis). In this example, a linearly polarized circular aluminum feed horn was fabricated and measured. Both its measured and simulated 10 dB impedance bandwidths can generally cover the entire frequency range of interest (30 GHz to 40 GHz). The realized antenna gain (mismatch included) of the feed horn varies between 12.5 and 15.1 dBi across the frequency range. At 35 GHz, the antenna gain is 14.7 dBi. The edge taper illuminated by the horn is about −10 dB.

The normalized far-field radiation pattern and antenna gain of the reflectarray antenna were measured using a far-field measurement system. FIG. 6B shows the measurement setup in an anechoic chamber for performing the measurement. In the measurement, a Ka-band (26.5-40 GHz) diagonal horn was used to transmit a signal, which was received by the antenna (dielectric reflectarray) under test (AUT). The AUT was installed on the turn table, at a distance of d=3.9 m from the transmitting horn. It satisfied the far-field condition of $d>2D^2/\lambda_0$, where D is the maximum dimension of the AUT or transmitting horn and $\lambda_0$ is the wavelength in air at 40 GHz.

Figure 7A:
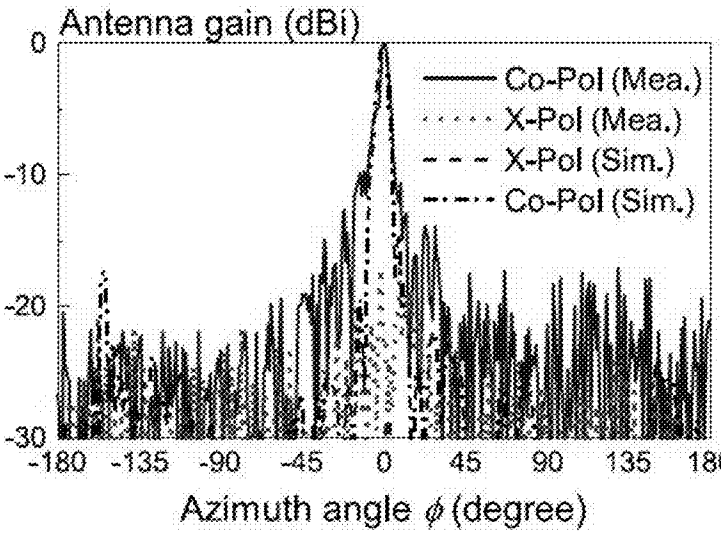
FIG. 7A is a plot showing measured and simulated 2D normalized far-field radiation patterns (or antenna gain) of the dielectric reflectarray antenna of FIG. 6A at 35 GHz on the Azimuth plane.
Figure 7B:
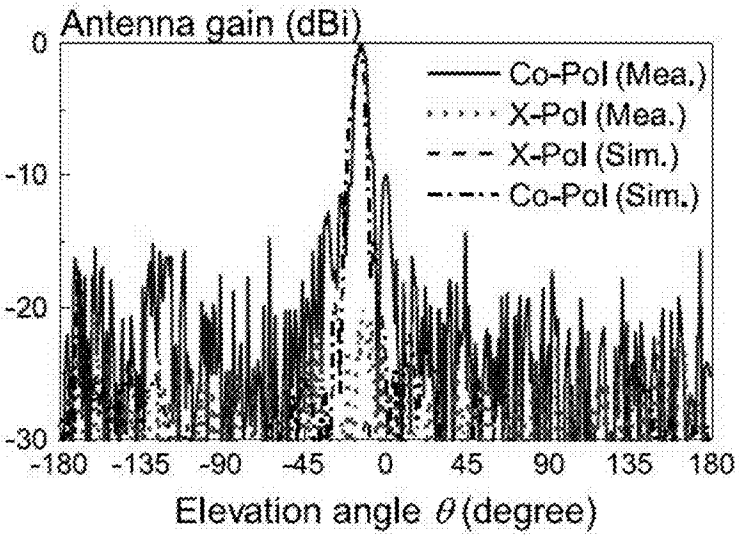
FIG. 7B is a plot showing measured and simulated 2D normalized far-field radiation patterns (or antenna gain) of the dielectric reflectarray antenna of FIG. 6A at 35 GHz on the Elevation plane.

FIGS. 7A and 7B show the measured and simulated 2-D normalized far-field radiation patterns. As shown in the Figures, good agreement between the measured and simulated main-beams can be observed. Ripples are also observed, but they are desirably much lower than the main-beam. Measured and simulated side-lobes are below −10 and −15 dB, respectively. The measured main-beam is along the direction of θ=13°, which is smaller than the designed angle (15°) by 2° due to experimental imperfections. FIGS. 7A and 7B also show the measured and simulated cross-polar fields. It can be observed that the measured cross-polar fields are lower than their co-polar counterparts by 20 dB to 30 dB.

Figure 8:
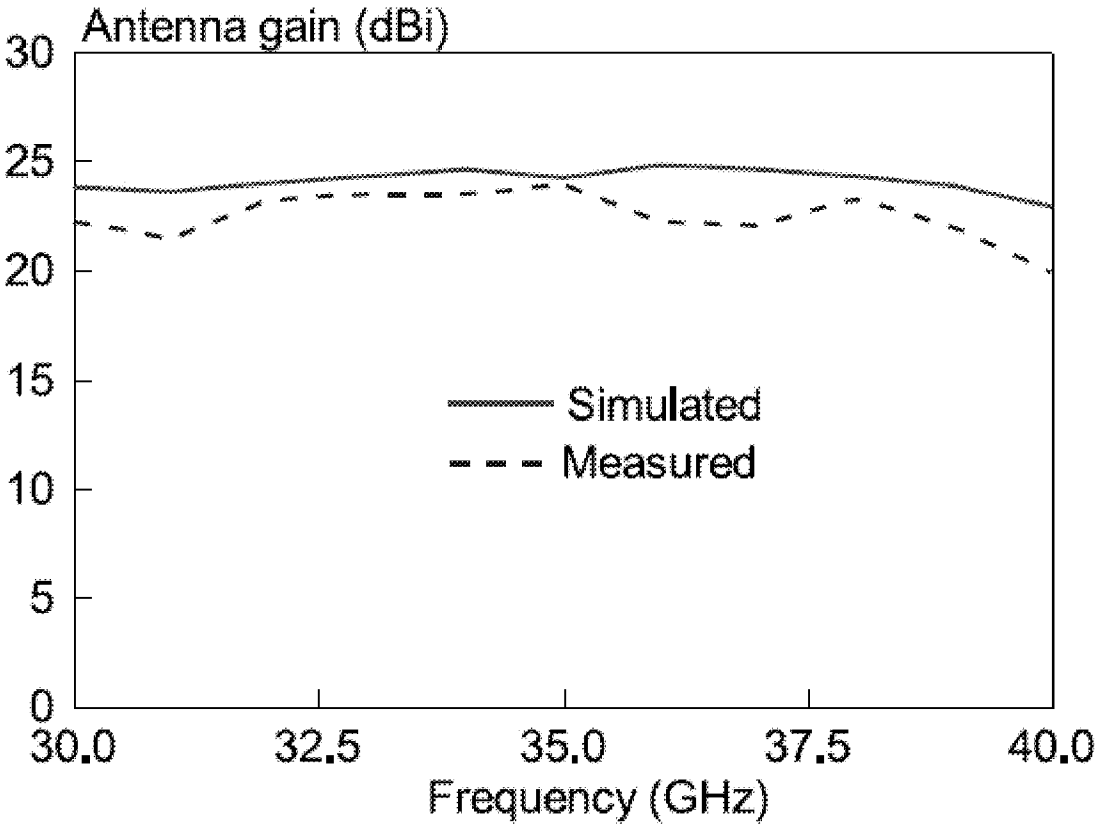
FIG. 8 is a graph showing measured and simulated antenna gains of the dielectric reflectarray antenna of FIG. 6A.

FIG. 8 shows the measured and simulated antenna gains of the dielectric reflectarray antenna. The maximum measured and simulated antenna gains are 23.9 and 24.8 dBi at 35 and 36 GHz, respectively. At 35 GHz, the measured antenna gain is lower than the simulated counterpart by 0.29 dB. The measured average gain reduction over 30 GHz to 40 GHz is 1.61 dB. The discrepancy is likely caused by fabrication tolerances and errors in measurement setup, including the alignment error between the transmitting horn and the AUT/standard gain horn. It is found that the measured gain of the reflectarray is 23.9 dBi, which is 9.2 dB higher than that using the feed horn (14.7 dBi) alone. In other words, the dielectric reflectarray in the above embodiment has a gain enhancement of 9.2 dB.

A study was carried out to examine the effect of fabrication tolerances on the radiation patterns. It was found that a fabrication tolerance of ±0.025 mm in the radius of the dielectric reflector element can increase the side-lobe level but decrease the antenna gain, with negligible effects on the main-beam direction. The effect of the tolerance in the dielectric constant of the substrate was also investigated. It was found that the antenna gain increases 0.2 dB when $\varepsilon_r$ increases 0.2. A gain reduction of 0.5 dB is found when $\varepsilon_r$ decreases 0.2. Again, the main beam is nearly the same in each case with an increased sidelobe level.

Table I compares the gain enhancements of the dielectric reflectarray antenna of the above embodiment (as fabricated) and three existing dielectric reflectarray antennas. In Table 1, Work A is based on S. Zhang, "*Three-dimensional printed millimetrewave dielectric resonator reflectarray,*" *IET Microw. Antennas Propag.*, vol. 11, no. 14, pp. 2005-2009, 2017; Work B is based on P. Nayeri et al., "*3D printed dielectric reflectarrays: Low-cost high-gain antennas at sub-millimeter waves,*" *IEEE Trans. Antennas Propag.*, vol. 62, no. 4, pp. 2000-2008, April 2014.; Work C is based on M. H. Jamaluddin et al., "*Design, fabrication and charac-*

*terization of a dielectric resonator antenna reflectarray in Ka-band," Prog. Electromagn.* Res. B, vol. 25, pp. 261-275, 2010.

Compared with the reflectarray antenna of Work A, the gain enhancement (9.2 dB) of the present embodiment is higher than its gain enhancement (9.0 dB) even though the present embodiment uses much fewer dielectric reflector elements (40% less). Also, whereas the areas of the two designs are about the same (~$155\lambda^2_0$), the profile of the present embodiment ($0.148\lambda_0$) is electrically much lower than that of the reflectarray antenna ($0.63\lambda_0$) of Work A. These favorable results are obtained because the design of the present embodiment uses a higher dielectric constant.

The reflectarray antenna of Work B has 400 elements. This number of array elements is only ~11% smaller than that of the present embodiment (446 elements), but the gain enhancement of the present embodiment is 2.3 dB higher. This is because the dielectric constant of the reflectarray antenna of Work B (2.78) is even lower than that of the reflectarray antenna of Work A (4.4). The volume of the present embodiment is, again, significantly smaller than that of the reflectarray antenna of Work B, as expected.

The monolithic reflectarray antenna in Work C is also considered here. The monolithic reflectarray antenna in Work C is not a pure dielectric design but has a metallic strip fabricated on each of its identical dielectric reflector elements. In its design, the phase change is obtained by varying the strip length rather than the dielectric reflector size. As compared with the present embodiment, the monolithic reflectarray has about the same area but has a smaller height. However, the gain enhancement of the present embodiment (9.2 dB) is higher than that of the monolithic reflectarray (8.3 dB). The lower gain enhancement of the monolithic design should be mainly caused by the loss due to the metallic strips. Also, since there is a size limitation for the monolithic fabrication, it needs to fabricate nine pieces of sub-reflectarrays and then combine them together to get the final design. In contrast, the dielectric reflectarray of the present embodiment can be fabricated in one go conveniently.

Embodiments illustrated above have provided a dielectric reflectarray antenna that can be made simply and cost effectively. In one embodiment, the linearly-polarized millimeter-wave substrate-based dielectric reflectarray operated in the frequency range from 30 GHz to 40 GHz and fabricated out of a single dielectric substrate (PCB substrate). The unit cell design avoids the alignment problem of the dielectric reflector elements so that the entire reflectarray can be fabricated easily and straightforwardly in one go. A measured peak antenna gain of 23.9 dBi has been obtained using the prototype to demonstrate the operability of the dielectric reflectarray antenna.

Microstrip reflectarrays, especially ones at millimeter-wave band, will suffer from surface-wave and ohmic loss as well as narrow gain bandwidth. Dielectric reflectarrays, like the ones proposed above, have higher efficiencies as they can get rid of the surface wave and eliminate conducting loss caused by the metals. On the other hand, existing dielectric reflectarrays that use discrete reflector elements need to fabricate each element individually and then fix them all at respective correct positions. These steps will lead to error and discrepancies. Especially, for reflectarray with a large number of elements, such fabrication and fixture would be time consuming and difficult. The above embodiments of the dielectric reflectarray antenna substantially reduces, if not eliminates, these issues.

It will be appreciated by persons skilled in the art that numerous variations and/or modifications may be made to the invention as shown in the specific embodiments without departing from the spirit or scope of the invention as broadly described. The described embodiments of the invention should therefore be considered in all respects as illustrative, not restrictive.

For example, the operating frequency of the dielectric reflectarray antenna can be of any value for different applications. The shape, size, form of the dielectric reflectarray antenna, the dielectric reflectarray, the unit cell, or the dielectric reflector element, its reflector part, or its connection part can be varied. The dielectric constant of the substrate can be of any available values, preferably above 5, more preferably at 6.15, 10 and 10.2 or even higher. The footprint of the reflectarray can be of any shape with any numbers of reflector elements.

The invention claimed is:

1. A method for making a dielectric reflectarray antenna using a substrate, wherein the substrate comprises a dielectric layer, a first outer metallic layer arranged on one side of the dielectric layer, and a second outer metallic layer arranged on another side of the dielectric layer, and wherein the method comprises:

removing the first outer metallic layer from the substrate to form an intermediate substrate that includes the dielectric layer and the second outer metallic layer;

integrally forming an array of dielectric reflector elements of the dielectric reflectarray antenna by cutting the intermediate substrate based on a predetermined pattern to remove part of the dielectric layer and a corresponding part of the second outer metallic layer such that each of the dielectric reflector elements includes a reflector portion for controlling a reflection phase response and a connection portion for directly connecting with at least one other adjacent dielectric reflector element; and attaching a conductive layer to the array of dielectric reflector elements.

2. The method of claim 1, wherein the substrate consists only of: the dielectric layer, the first outer metallic layer, and the second outer metallic layer.

3. The method of claim 1, wherein the substrate is a single PCB substrate.

4. The method of claim 1, wherein the first outer metallic layer is a copper cladding layer.

5. The method of claim 1, wherein the first outer metallic layer is a copper cladding layer, and the second outer metallic layer is a copper cladding layer.

6. The method of claim 1, wherein the dielectric layer has a dielectric constant of at least 5.

7. The method of claim 1, wherein removing comprises laser-etching the first outer metallic layer.

8. The method of claim 1, wherein removing comprises chemically-etching the first outer metallic layer.

9. The method of claim 1, wherein cutting comprises cutting the intermediate substrate using a milling cutter.

10. The method of claim 1, wherein cutting comprises cutting the intermediate substrate using a computer-numerical-controlled milling cutter.

11. The method of claim 1, wherein the connection portion includes one or more arms extending from the reflector portion.

12. The method of claim 1, wherein the connection portion of at least some of the dielectric reflector elements includes a plurality of arms extending from the reflector portion, the plurality of arms being spaced apart evenly.

13. The method of claim 1, wherein the reflector portion is generally cylindrical, and the connection portion includes one or more arms extending radially from the reflector portion.

14. The method of claim 1, wherein the conductive layer comprises a conductive bonding film.

15. The method of claim 1, wherein attaching comprises:

attaching the conductive layer to the second outer metallic layer of the array of dielectric reflector elements.

16. A dielectric reflectarray antenna formed by a method for making a dielectric reflectarray antenna using a substrate, the substrate including a dielectric layer, a first outer metallic layer arranged on one side of the dielectric layer, and a second outer metallic layer arranged on another side of the dielectric layer; wherein the method comprises:

removing the first outer metallic layer from the substrate to form an intermediate substrate that includes the dielectric layer and the second outer metallic layer;

integrally forming an array of dielectric reflector elements of the dielectric reflectarray antenna by cutting the intermediate substrate based on a predetermined pattern to remove part of the dielectric layer and a corresponding part of the second outer metallic layer such that each of the dielectric reflector elements includes a reflector portion for controlling a reflection phase response and a connection portion for directly connecting with at least one other adjacent dielectric reflector element; and attaching a conductive layer to the array of dielectric reflector elements;

wherein the dielectric reflectarray antenna formed by the method comprises:

an array of integrally formed dielectric reflector elements each including a reflector portion for controlling a reflection phase response and a connection portion for directly connecting with at least one other adjacent dielectric reflector element, and a conductive layer attached to the array of integrally formed dielectric reflector elements.

17. The dielectric reflectarray antenna of claim 16, wherein the dielectric layer has a dielectric constant of at least 5.

18. The dielectric reflectarray antenna of claim 16, wherein the connection portion includes one or more arms extending from the reflector portion.

19. The dielectric reflectarray antenna of claim 16, wherein the connection portion of at least some of the dielectric reflector elements includes a plurality of arms extending from the reflector portion, the plurality of arms being spaced apart evenly.

20. The dielectric reflectarray antenna of claim 16, wherein the reflector portion is generally cylindrical, and the connection portion includes one or more arms extending radially from the reflector portion.

21. The dielectric reflectarray antenna of claim 16, wherein the conductive layer is attached to the second outer metallic layer of the array of dielectric reflector elements.

22. The dielectric reflectarray antenna of claim 16, wherein the conductive layer comprises a conductive bonding film.

23. The dielectric reflectarray antenna of claim 16, wherein the dielectric reflectarray antenna is a millimeter-wave dielectric reflectarray antenna.

24. A communication apparatus comprising the dielectric reflectarray antenna of claim 16.

* * * * *